US010281846B2

(12) United States Patent
Iida et al.

(10) Patent No.: US 10,281,846 B2
(45) Date of Patent: May 7, 2019

(54) IMAGE FORMING APPARATUS

(71) Applicant: CANON KABUSHIKI KAISHA, Tokyo (JP)

(72) Inventors: Kenichi Iida, Tokyo (JP); Takao Kume, Yokohama (JP); Yusuke Shimizu, Yokohama (JP); Keisuke Ishizumi, Hiratsuka (JP); Toshihiko Takayama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/828,990

(22) Filed: Dec. 1, 2017

(65) Prior Publication Data

US 2018/0157195 A1 Jun. 7, 2018

(30) Foreign Application Priority Data

Dec. 2, 2016 (JP) ..... 2016-235234

(51) Int. Cl.
*G03G 15/00* (2006.01)
*G03G 15/16* (2006.01)

(52) U.S. Cl.
CPC ..... *G03G 15/1605* (2013.01); *G03G 15/16* (2013.01); *G03G 15/161* (2013.01);
(Continued)

(58) Field of Classification Search
CPC .. G03G 15/16; G03G 15/1605; G03G 15/161; G03G 15/162; G03G 15/1675;
(Continued)

(56) References Cited

U.S. PATENT DOCUMENTS 9,063,497 B2 6/2015 Katagiri et al.
9,158,241 B2 10/2015 Shimizu
(Continued)

FOREIGN PATENT DOCUMENTS

JP 2004-062087 A 2/2004
JP 2013-231948 A 11/2013
(Continued)

OTHER PUBLICATIONS

Machine Translation of JP 2016-145908. Aug. 12, 2016.*
(Continued)

*Primary Examiner* — Carla J Therrien
(74) *Attorney, Agent, or Firm* — Venable LLC

(57) ABSTRACT

The image forming apparatus includes an image bearing member; an ionically conductive intermediate transferring belt; a primary transfer member; an opposing member that opposes the current supply member through the intermediate transferring belt, and a control unit configured to execute a recovery operation in a state where a primary transfer in which a toner image is primarily transferred to the image intermediate transferring belt from the image bearing member is not performed, wherein the recovery operation includes to supply a current flowing in a flow direction opposite to a flow direction of a current in the primary transfer through the opposing member from the current supply member to remove an uneven distribution of the conductive agent in the intermediate transferring belt caused by primary transfer.

12 Claims, 9 Drawing Sheets

(52) U.S. Cl.
CPC ..... *G03G 15/1675* (2013.01); *G03G 15/5004* (2013.01); *G03G 15/5054* (2013.01)

(58) Field of Classification Search
CPC ..... G03G 15/168; G03G 15/5004; G03G 15/5054
See application file for complete search history.

(56) References Cited

U.S. PATENT DOCUMENTS

| | | | | |
|---|---|---|---|---|
| 9,195,174 | B2 | 11/2015 | Kobayashi et al. | |
| 9,494,894 | B2 | 11/2016 | Tetsuno et al. | |
| 2014/0119761 | A1* | 5/2014 | Matayoshi ..... | G03G 15/1675 399/66 |
| 2015/0003880 | A1* | 1/2015 | Ohno ..... | G03G 15/80 399/302 |
| 2015/0338791 | A1* | 11/2015 | Matsushita ..... | G03G 15/1615 399/66 |
| 2018/0039198 | A1* | 2/2018 | Saito ..... | G03G 15/0121 |
| 2018/0039209 | A1* | 2/2018 | Ishizumi ..... | G03G 15/1665 |
| 2018/0181020 | A1* | 6/2018 | Ito ..... | G03G 15/0266 |

FOREIGN PATENT DOCUMENTS

| | | | |
|---|---|---|---|
| JP | 2015-114498 | A | 6/2015 |
| JP | 2016-145908 | A | 8/2016 |

OTHER PUBLICATIONS

U.S. Appl. No. 15/662,832, Seiji Saito, Keisuke Ishizumi, Toshihiko Takayama, Masaru Ohno, Shingo Ito, Shohei Ishio, Keisuke Samejima, Keizo Kojima, Ryo Matsumura, filed Jul. 28, 2017.
U.S. Appl. No. 15/644,239, Keisuke Ishizumi, Seiji Saito, Toshihiko Takayama, Masaru Ohno, Shingo Ito, Shohei Ishio, filed Jul. 31, 2017.
U.S. Appl. No. 15/843,472, Shingo Ito, Toshihiko Takayama, Keisuke Ishizumi, Shohei Ishio, Kenichi Iida, filed Dec. 15, 2017.

* cited by examiner

IMAGE FORMING APPARATUS

BACKGROUND OF THE INVENTION

Field of the Invention

The present invention relates to an image forming apparatus, such as a copying machine, a printer and a facsimile apparatus, using an electrophotographic system or an electrostatic recording system.

Description of the Related Art

Conventionally, an example of an image forming apparatus using an electrophotographic system or the like includes an image forming apparatus of an intermediate transfer system that primarily transfers a toner image formed on an image bearing member, such as a photoreceptor, to an intermediate transfer member and then secondarily transfers the toner image to a recording material.

In the image forming apparatus of the intermediate transfer system, the primary transfer of the toner image from the image bearing member to the intermediate transfer member is often performed by applying a voltage to a contact member arranged on an opposing portion of the image bearing member through the intermediate transfer member. The secondary transfer of the toner image from the intermediate transfer member to the recording material is often performed by applying a voltage to a secondary transfer member arranged in contact with the intermediate transfer member.

On the other hand, Japanese Patent Application Laid-Open No. 2013-231948 proposes a configuration of performing the primary transfer by applying a voltage to a current supply member that is in contact with an outer peripheral surface of a conductive intermediate transfer member to supply a current to a contact member. According to the configuration, for example, a secondary transfer member can be used as the current supply member to reduce high-voltage power supply dedicated to the primary transfer, thereby reducing the cost and the size of the image forming apparatus.

SUMMARY OF THE INVENTION

An aspect of the present invention provides an image forming apparatus that can prevent a transfer failure caused by uneven distribution of a conductive agent in a member.

Another aspect of the present invention provides an image forming apparatus including an image forming apparatus including an image bearing member configured to bear a toner image; an intermediate transferring belt having ionic conductivity with an ionic conductive agent; a contact member that is in contact with an inner peripheral surface of the intermediate transferring belt; a current supply member that is in contact with an outer peripheral surface of the intermediate transferring belt; an opposing member that opposes the current supply member through the intermediate transferring belt, wherein the opposing member is in contact with the inner peripheral surface of the intermediate transferring belt, the opposing member electrically connected to the contact member; and a control unit configured to execute a recovery operation in a state where a primary transfer in which a toner image is primarily transferred to the image intermediate transferring belt from the image bearing member is not performed, wherein the recovery operation includes to supply a current flowing in a flow direction opposite to a flow direction of a current in the primary transfer through the opposing member from the current supply member to remove an uneven distribution of the conductive agent in the intermediate transferring belt caused by primary transfer.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

An image forming apparatus according to the present invention will now be described in further detail with reference to the drawings.

First Embodiment

1. Overall Configuration and Operation of Image Forming Apparatus

Figure 1:
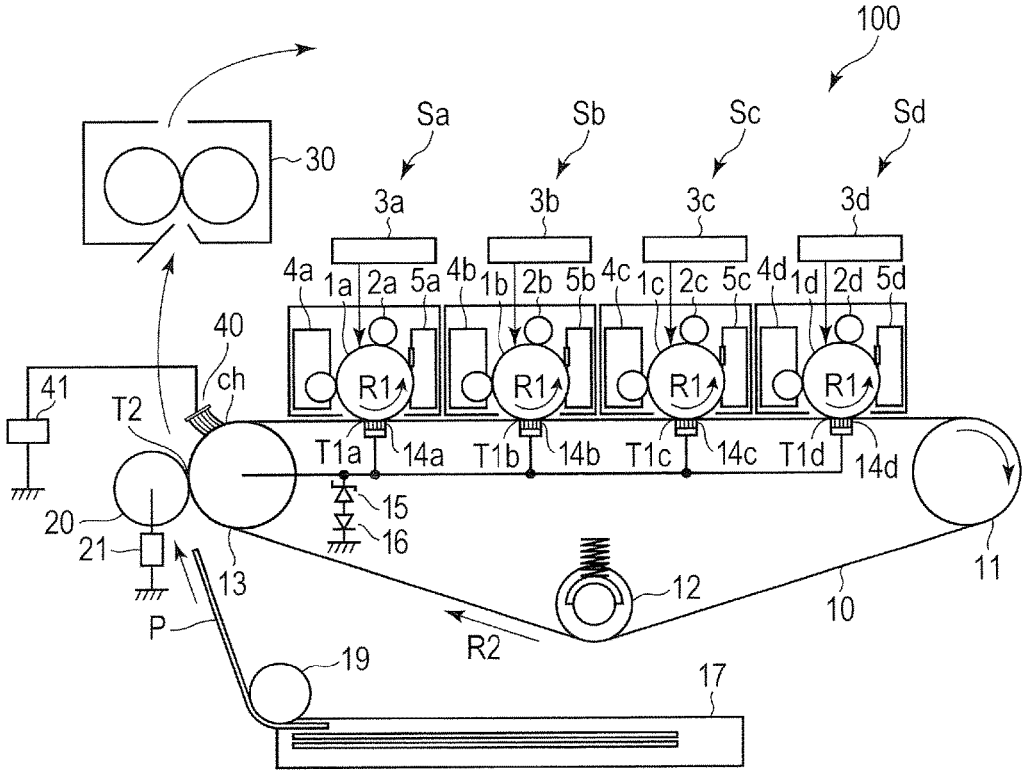
FIG. 1 is a schematic cross-sectional view of an image forming apparatus according to a first embodiment.

FIG. 1 is a schematic cross-sectional view of an image forming apparatus 100 of the present embodiment. The image forming apparatus 100 of the present embodiment is a tandem printer adopting an intermediate transfer system that can use an electrophotographic system to form a full-color image.

The image forming apparatus 100 includes first, second, third and fourth image forming units (stations) Sa, Sb, Sc and Sd that form yellow (Y), magenta (M), cyan (C) and black (K) toner images, respectively. Elements with the same or corresponding functions or configurations in the image forming units Sa, Sb, Sc and Sd may be comprehensively described by omitting a, b, c and d attached to the reference signs indicating the colors of the elements. In the present embodiment, the image forming unit S includes a photosensitive drum 1, a charging roller 2, an exposure apparatus 3, a development apparatus 4, a primary transfer brush 14 and a cleaning apparatus 5 described later.

The photosensitive drum 1 that is a rotatable drum-type (cylindrical) photoreceptor (electrophotographic photoreceptor) as an image bearing member that bears a toner image is rotated and driven in an arrow R1 direction in FIG. 1 at a predetermined peripheral speed (process speed). In the present embodiment, the process speed is 150 mm/sec. The charging roller 2 that is a roller-type photoreceptor charging member as a photoreceptor charging unit uniformly charges the surface of the rotating photosensitive drum 1 at a predetermined potential with a predetermined polarity (negative polarity in the present embodiment). The exposure apparatus 3 as an exposure unit scans and exposes the surface of the charged photosensitive drum 1 according to image information, and an electrostatic latent image (electrostatic image) is formed on the photosensitive drum 1. In the present embodiment, the potential of the part (non-image part potential) of the surface of the photosensitive drum 1 charged by the charging roller 2 is −500 V, and the potential of the exposed part (image part potential) is −200 V. The development apparatus 4 as a development unit uses the toner as a developer to develop (visualize) the electrostatic latent image formed on the photosensitive drum 1, and a toner image is formed on the photosensitive drum 1. In the present embodiment, the toner charged with the same polarity as the charge polarity of the photosensitive drum 1 adhered on the exposed part on the photosensitive drum 1 in which the absolute value of the potential decreases by the exposure after the uniform charge. In the present embodiment, the regular charge polarity of the toner that is the charge polarity of the toner during the development is a negative polarity.

An intermediate transferring belt 10 as an intermediate transfer member including an endless belt is arranged to oppose each photosensitive drum 1 of each image forming unit S. The intermediate transferring belt 10 is bridged over a drive roller 11, a tension roller 12 and a secondary transfer opposing roller 13 as a plurality of stretching rollers (stretching members) and is stretched at a predetermined tension. The drive roller 11 is rotated and driven to rotate (circularly move) the intermediate transferring belt 10 in an arrow R2 direction in FIG. 1 (direction of movement in the same direction as the photosensitive drum 1 at the part of contact with the photosensitive drum 1) at substantially the same peripheral speed as the peripheral speed of the photosensitive drum 1. On the inner peripheral surface (backside surface) side of the intermediate transferring belt 10, the primary transfer brush 14 that is a brush-like contact member as a primary transfer unit is arranged to correspond to each photosensitive drum 1. In the present embodiment, the primary transfer brush 14 is a contact member that is arranged to oppose the photosensitive drum 1 through the intermediate transferring belt 10 and that is in contact with the inner peripheral surface of the intermediate transferring belt 10. The primary transfer brush 14 is pressed toward the photosensitive drum 1 through the intermediate transferring belt 10 to form a primary transfer section (primary transfer nip section) T1 where the photosensitive drum 1 and the intermediate transferring belt 10 are in contact.

The toner image formed on the photosensitive drum 1 is transferred (primarily transferred) to the intermediate transferring belt 10 at the primary transfer section T1 through the action of the primary transfer brush 14. For example, during formation of a full-color image, the yellow, magenta, cyan and black toner images formed on the photosensitive drums 1 are sequentially primarily transferred on top of each other to the intermediate transferring belt 10. The configuration and the action of the primary transfer brush 14 will be described in further detail later.

On the outer peripheral surface (surface) side of the intermediate transferring belt 10, a secondary transfer roller 20 that is a roller-type secondary transfer member as a secondary transfer unit is arranged at a position opposing the secondary transfer opposing roller 13. The secondary transfer roller 20 is pressed toward the secondary transfer opposing roller 13 through the intermediate transferring belt 10 to form a secondary transfer section (secondary transfer nip section) T2 where the intermediate transferring belt 10 and the secondary transfer roller 20 are in contact.

The toner image formed on the intermediate transferring belt 10 is transferred (secondarily transferred) to a recording material (recording medium, paper) P, such as a sheet, conveyed between the intermediate transferring belt 10 and the secondary transfer roller 20 at the secondary transfer section T2 through the action of the secondary transfer roller 20. A secondary transfer power supply (high-voltage power supply circuit) 21 is connected to the secondary transfer roller 20. During the secondary transfer, the secondary transfer power supply 21 provides the secondary transfer roller 20 with a DC voltage with polarity (positive polarity in the present embodiment) opposite the regular charge polarity of the toner. The recording material P is stored in a storage cassette 17 and conveyed by a feed roller 19 and the like. The recording material P is supplied to the secondary transfer section T2 according to the timing of the toner image on the intermediate transferring belt 10.

The recording material P to which the toner image is transferred is conveyed to a fixing apparatus 30 as a fixing unit. The fixing apparatus 30 heats and pressurizes the recording material P to fix (melt and fix) the toner image. The recording material P is then discharged (output) to the outside of the body of the image forming apparatus 100.

On the other hand, the toner (primary transfer residual toner) remained on the surface of the photosensitive drum 1 after the primary transfer is removed and collected by the cleaning apparatus 5 as a cleaning unit from the surface of the photosensitive drum 1. In the cleaning apparatus 5, a cleaning blade as a cleaning member arranged in contact with the surface of the photosensitive drum 1 scrapes and collects the primary transfer residual toner from the surface of the rotating photosensitive drum 1.

On the outer peripheral surface side of the intermediate transferring belt 10, a toner charging brush 40 that is a brush-like charge member is arranged as a toner charging unit that charges the toner on the belt, at the position opposing the secondary transfer opposing roller 13. The toner charging brush 40 forms a toner charge section Ch by coming into contact with the surface of the intermediate transferring belt 10 on the downstream of the secondary transfer section T2 and the upstream of the primary transfer section T1 (primary transfer section T1*a* of the most upstream) in the rotation direction of the intermediate transferring belt 10. The toner (secondary transfer residual toner) remained on the surface of the intermediate transferring belt 10 after the secondary transfer is charged by the toner charging brush 40 at the toner charge section Ch and is transferred to a photosensitive drum 1*a* at the primary transfer section T1*a* of the first image forming unit Sa in the present embodiment. A cleaning apparatus 5*a* collects the secondary transfer residual toner transferred to the photosensitive drum 1*a* of the first image forming unit Sa. A charge power supply (high-voltage power supply circuit) 41 is connected to the toner charging brush 40. In charging the secondary transfer residual toner, the charge power supply 41 provides the toner charging brush 40 with a DC voltage with polarity (positive polarity in the present embodiment) opposite the regular charge polarity of the toner. As a result, the secondary transfer residual toner on the intermediate transferring belt 10 is charged with positive polarity. The secondary transfer residual toner charged with positive polarity is transferred to the photosensitive drum 1*a* by electrostatic repellent force at the primary transfer section T1*a* of the first image forming unit Sa. The toner can be transferred from the intermediate transferring belt 10 to the photosensitive drum 1*a* of the first image forming unit Sa at the same time as the primary transfer of the toner image from the photosensitive drum 1*a* to the intermediate transferring belt 10.

Figure 2:
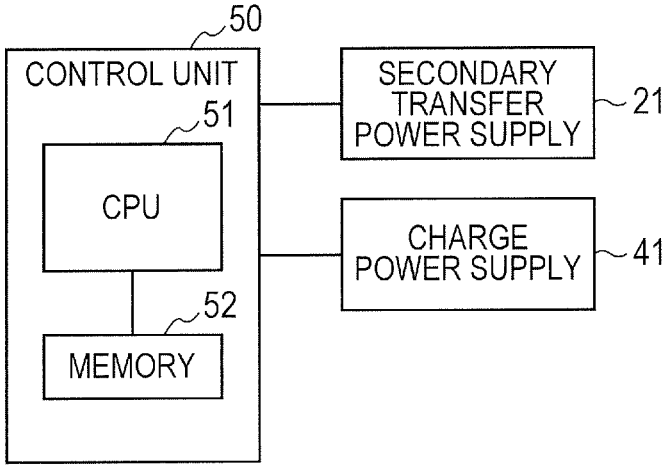
FIG. 2 is a block diagram illustrating a control mode of main parts of the image forming apparatus according to the first embodiment.

FIG. 2 is a block diagram illustrating a control mode of main parts of the image forming apparatus 100 according to the present embodiment. In the present embodiment, a control unit (control circuit) 50 provided on the apparatus body controls the operation of each component of the image forming apparatus 100. The control unit 50 includes a CPU 51 as an arithmetic control unit and a memory 52, such as a ROM and a RAM, as a storage unit. In the control unit 50, the CPU 51 sequentially operates each component of the image forming apparatus 100 according to a program stored in the memory 52. Particularly, the control unit 50 in the present embodiment switches ON/OFF and controls the output of the secondary transfer power supply 21 and the charge power supply 41 described later to change and control the direction of the current supplied to the primary transfer brush 14 through an image forming operation and a recovery operation described later.

Here, the image forming apparatus 100 executes a job (print operation) that is started by a start instruction and that is a series of operations for forming and outputting images to one or a plurality of recording materials P. The job generally includes a pre-processing operation, an image forming operation and a post-processing operation. The image forming operation generally includes formation of an electrostatic latent image of the image formed and output to the recording material P, formation of a toner image, a print operation for the primary transfer and the secondary transfer of the toner image, and interleaving in forming images on a plurality of transfer materials P. The pre-processing operation (pre-rotation operation) is a period for performing a stand-by operation from the input of the start instruction to the start of the image forming operation. The post-processing operation (post-rotation operation) is a period for performing a preparation operation (stand-by operation) after the end of the image forming operation. A non-image forming period includes the pre-processing operation period and the post-processing operation period, as well as the interleaving and a pre-multi-rotation period that is a stand-by operation during power activation of the image forming apparatus 100 or during return from a sleep state.

2. Transfer Configuration

The intermediate transferring belt 10 includes a conductive endless belt and is supported by three axes of the drive roller 11, the tension roller 12 and the secondary transfer opposing roller 13. The tension roller 12 stretches the intermediate transferring belt 10 with the tension at a total pressure of 60 N.

The primary transfer brush 14 includes a brush portion formed by conductive fibers and is in contact with the backside surface of the intermediate transferring belt 10 at a pressure of 3 N. At a fixed position relative to the intermediate transferring belt 10, the primary transfer brush 14 is arranged with a predetermined amount of penetration into the backside surface of the intermediate transferring belt 10. The primary transfer brush 14 rubs against the backside surface of the intermediate transferring belt 10 along with the movement of the intermediate transferring belt 10. The primary transfer brush 14 is an example of a contact member as a primary transfer member that is in contact with the inner peripheral surface of the intermediate transferring member and that primarily transfers the toner image from the image bearing member to the intermediate transferring member.

The secondary transfer roller 20 is an elastic roller with an outer diameter of 18 mm, in which the outer periphery of a core metal (core material) including a nickel-plated steel bar with an outer diameter of 8 mm is covered by an elastic layer with a thickness of 5 mm including a foam sponge body. The foam sponge body serves as a surface of contact with the intermediate transferring belt 10. The foam sponge body is made of a material containing NBR and epichlorohydrin rubber as main ingredients. The volume resistivity is adjusted at $10^8$ Ω·cm, and the secondary transfer roller 20 is conductive. The secondary transfer roller 20 is in contact with the intermediate transferring belt 10 at a pressure of 50 N and follows the movement of the intermediate transferring belt 10 to rotate. The secondary transfer roller 20 is an example of a current supply member in contact with the outer peripheral surface of the intermediate transferring member.

The toner charging brush 40 includes a brush portion formed by conductive fibers and is pressurized and brought into contact with the surface of the intermediate transferring belt 10. At a fixed position relative to the intermediate transferring belt 10, the toner charging brush 40 is arranged at a predetermined amount of penetration into the surface of the intermediate transferring belt 10, and the toner charging brush 40 rubs against the surface of the intermediate transferring belt 10 along with the movement of the intermediate transferring belt 10. The toner charging brush 40 is another example of the current supply member in contact with the outer peripheral surface of the intermediate transferring member.

The secondary transfer opposing roller 13 is an elastic roller with an outer diameter of 29.8 mm, in which the outer periphery of an aluminum core metal (core material) with an outer diameter of 26.0 mm is covered by an elastic layer with a thickness of 1.9 mm including a hydrin rubber layer. The hydrin rubber layer serves as a surface of contact with the intermediate transferring belt 10. The electric resistance of the hydrin rubber layer is adjusted to set the electric resistance value of the secondary transfer opposing roller 13 to $10^6$Ω, and the secondary transfer opposing roller 13 is conductive. The rubber hardness of the hydrin rubber layer is 40° in the JIS-A standard. The secondary transfer roller 20 and the toner charging brush 40 are in contact with the secondary transfer opposing roller 13 through the intermediate transferring belt 10. The secondary transfer opposing roller 13 is an example of an opposing member that opposes the current supply member through the intermediate transferring member, that is in contact with the inner peripheral surface of the intermediate transferring member, and that is electrically connected to the contact member.

The secondary transfer opposing roller 13 is electrically grounded (connected to the ground) through a voltage maintaining element 15 and a rectification element 16. Primary transfer brushes 14*a*, 14*b*, 14*c* and 14*d* are also electrically grounded through the same voltage maintaining element 15 and rectification element 16. Therefore, the primary transfer brush 14 and the secondary transfer opposing roller 13 are electrically grounded through a common voltage maintaining element. In the present embodiment, a Zener diode that is a constant voltage element at 700 V is used for the voltage maintaining element 15. In the present embodiment, a diode with a withstand voltage of 3000 V is used for the rectification element 16. The Zener diode 15 is connected between the set of the secondary transfer opposing roller 13 and the primary transfer brush 14 and a grounded location, in a direction in which the potential of the intermediate transferring belt 10 is maintained at a predetermined potential of positive polarity (70 V in the present embodiment). More specifically, the cathode side of the Zener diode 15 is connected to the secondary transfer opposing roller 13 and the primary transfer brush 14, and the anode side is connected to the grounded location. The diode 16 is connected between the Zener diode 15 and the grounded location, in a direction in which only the current from the Zener diode 15 side toward the grounded location flows. More specifically, the anode side of the diode 16 is connected to the Zener diode 15, and the cathode side is connected to the grounded location.

Note that the drive roller 11 and the tension roller 12 are electrically floating in the present embodiment.

In the present embodiment, the secondary transfer power supply 21 and the charge power supply 41 are also used as power supplies for the primary transfer at each primary transfer section T1. More specifically, in the primary transfer, the second transfer power supply 21 and the charge power supply 41 apply a DC voltage with polarity (positive polarity in the present embodiment) opposite the regular charge polarity of the toner. As a result, a current is supplied to the primary transfer brush 14 through the secondary transfer opposing roller 13. Although the current flows to the grounded location, each primary transfer brush is maintained at substantially the same predetermined potential of positive polarity (+700 V in the present embodiment) because the Zener diode 15 is provided. As a result, a transfer current flowing from the intermediate transferring belt 10 to the photosensitive drum 1 based on a potential difference between the intermediate transferring belt 10 and the photosensitive drum 1 at the primary transfer section T1 causes the primary transfer of the toner with negative polarity on the photosensitive drum 1 to the intermediate transferring belt 10. In the present embodiment, the primary transfer, the secondary transfer, the charge of the secondary transfer residual toner, and the transfer of the secondary transfer residual toner to the photosensitive drum 1 can be performed at the same time.

3. Configuration of Intermediate Transferring Member

Figure 3:
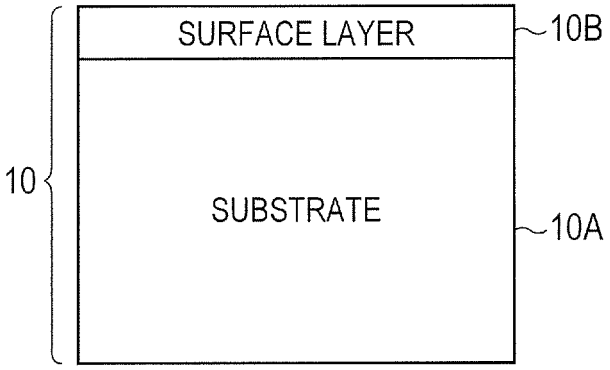
FIG. 3 is a schematic cross-sectional view of an intermediate transferring member according to the first embodiment.

FIG. 3 is a schematic cross-sectional view of the intermediate transferring belt 10 according to the present embodiment. In the present embodiment, the intermediate transferring belt 10 includes a base layer (substrate) 10A and a surface layer (coat layer) 10B. More specifically, the base layer 10A is in contact with the stretching members, such as the secondary transfer opposing roller 13, and with the primary transfer brush 14 in the present embodiment. In the present embodiment, the surface layer 10B provided closer to the outer peripheral surface of the intermediate transferring belt 10 than the base layer 10A is in contact with the secondary transfer roller 20 and the toner charging brush 40.

In the present embodiment, the thickness of the base layer 10A is 65 μm. The base layer 10A contains an ionically conductive agent and is ionically conductive.

Examples of a base resin material of the base layer 10A include thermoplastic resins, such as polycarbonate, polyvinylidene fluoride (PVDF), polyethylene, polypropylene, polymethylpentene-1, polystyrene, polyamide, polysulfone, polyarylate, polyethylene terephthalate, polybutylene terephthalate, polyethylene naphtha late, polybutylene naphthalate, polyphenylene sulfide, polyether sulfone, polyether nitrile, thermoplastic polyimide, polyether ether ketone, thermotropic liquid crystal polymer and polyamide acid. Two or more types of these may be mixed and used.

Examples of the ionically conductive agent of the base layer 10A include polyvalent metal salt and quaternary ammonium salt. Examples of a cation of the quaternary ammonium salt include tetraethylammonium ion, tetrapropylammonium ion, tetraisopropylammonium ion, tetrabutylammonium ion, tetrapentylammonium ion and tetrahexylammonium ion. Examples of an anion include halogen ion, as well as fluoroalkyl sulfate ion, fluoroalkyl sulfite ion, and fluoroalkyl borate ion with carbon numbers of 1 to 10 in the fluoroalkyl group. A polyetheresteramide resin may be mainly used, and perfluoro potassium butane sulfonic acid may also be used and added to the polyetheresteramide resin.

The base layer 10A as a resin composition can be obtained by melting and kneading the material components and then appropriately selecting and using a molding method, such as inflation molding, cylindrical extrusion molding and injection stretch blow molding. In the present embodiment, the volume resistivity of the base layer 10A is $10^9$ Ωcm, and the base layer 10A is conductive.

In the present embodiment, the thickness of the surface layer 10B is 2 μm. The surface layer 10B contains an electronically conductive agent and is electronically conductive. Therefore, the surface layer 10B is not ionically conductive in the present embodiment.

The surface layer 10B can be provided by applying dip coating, spray coating, roll coating, spin coating, and the like to the base layer 10A. Examples of the base material of the surface layer 10B include curable resins, such as a melamine resin, a urethane resin, an alkyd resin and an acrylic resin. The surface layer 10B is highly airtight. The volume resistivity of the surface layer 10B is $10^{11}$ Ωcm, and the surface layer 10B is conductive.

In the present embodiment, the base layer 10A is particularly formed by a material in which polyethylene naphthalate containing an ionic conductive agent is the main component. In the present embodiment, the surface layer 10B is particularly formed by a material in which an acrylic resin containing an electronic conductive agent is the main component.

Note that the volume resistivity of the intermediate transferring belt 10 can be measured by using Hiresta-UP (MCP-HT450) of Mitsubishi Chemical Corporation at room temperature of 23° C., room humidity of 50%, applied voltage of 100 V and measurement time of 10 sec. The electric resistance of the intermediate transferring belt 10 (each layer) is suitably about $1\times10^7$ to $3\times10^{11}$ Ω·cm in terms of volume resistivity.

When the intermediate transferring belt 10 is used to repeatedly output images, the conductive agent may be unevenly distributed in the intermediate transferring belt 10, and a transfer failure may occur. When the conductive agent is unevenly distributed in the intermediate transferring belt 10, the conductive agent may be precipitated on the back surface side of the intermediate transferring belt 10. A compound may be formed, and the conductivity may decrease. The compound adheres the surface of the contact member, and this causes a transfer failure due to an increase in the electric resistance. Therefore, the image forming apparatus 100 in the present embodiment is configured to execute an operation sequence to prevent the uneven distribution of the conductive agent in the intermediate transferring belt 10, particularly, in the base layer 10A, as described in detail later.

4. Configuration of Primary Transfer Brush

Figure 4:
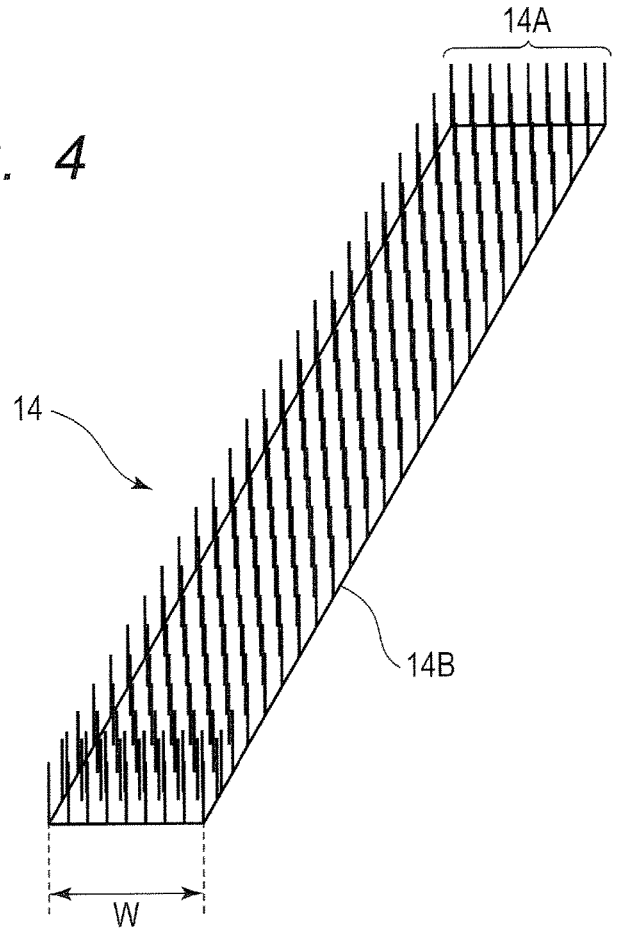
FIG. 4 is a schematic perspective view of a primary transfer brush.

FIG. 4 is a schematic perspective view of the primary transfer brush 14 according to the present embodiment.

A brush member including conductive brush fibers (brush portion) 14A sufficiently densely arrayed on a base plate 14B can be used for the primary transfer brush 14. In the present embodiment, a dimension W of the primary transfer brush 14 in a short direction is 4 mm. The short direction of the primary transfer brush 14 is a direction of arrangement substantially perpendicular to the rotational axis direction of the photosensitive drum 1 (substantially parallel to the movement direction of the intermediate transferring belt 10). The dimension W is a size that allows to form a nip with a sufficient width between the primary transfer brush 14 and the intermediate transferring belt 10 in order to obtain a good transferability. Note that the dimension of the primary transfer brush 14 in the longitudinal direction (substantially parallel to the rotational axis direction of the photosensitive drum 1) is equal to or longer than the length of an image forming area of the photosensitive drum 1 in the rotational axis direction (area where a toner image can be formed).

A pile fabric type brush member or an electrostatic flocking type brush member can be used for the primary transfer brush 14. The pile fabric is formed by weaving pile yarn as the brush fibers 14A into gaps of basic fabric (not shown) including the warp and the weft. A conductive adhesive or the like is used to fix the pile fabric on the base plate 14B through bonding or the like to obtain the primary transfer brush 14 that is a brush-like transfer member. The electrostatic flocking is a method of using electrostatic attraction in a high-voltage electrostatic field to anchor short fibers as brush fibers substantially perpendicularly on the base plate 14B provided with an adhesive in advance, and the primary transfer brush 14 is also obtained in this way.

Fibers with conductivity (conductive fibers), particularly, synthetic fibers containing a conductive agent, can be used for the brush fibers. For example, a material, such as nylon and polyester with dispersed carbon powder, can be used. The material can have single yarn fitness of 2 to 15 dtex, diameter of 10 to 40 μm, and dry strength of 1 to 3 cN/dtex. The resistivity of the brush fibers can be in a range of $10^2$ to $10^8$ Ωcm to improve the transfer efficiency.

In the present embodiment, the brush fibers 14A as pile fabric formed by the base fabric and the pile yarn are fixed to the upper surface of the substantially uniformly flat base plate 14B made of stainless steel to form the primary transfer brush 14. In the present embodiment, the base plate 14B is a rectangular sheet metal with the dimension W in the short direction, as described above. The length of the brush fibers 14A from the base plate (length of fibers) can be, for example, 1 to 5 mm. The array density of the brush fibers 14A on the base plate 14B can be, for example, 5000 to 50000 fibers/$cm^2$.

In the present embodiment, a brush member with the following specifications is used for the primary transfer brush 14 with representative characteristics.

Member type: pile fabric

Material of brush fibers: nylon fibers with dispersed carbon powder

Diameter of brush fibers: 17 μm

Resistivity of brush fibers: $10^5$ Ωcm

Length of fibers: 1.5 mm

Array density: 43520 fibers/$cm^2$

5. Configuration of Toner Charging Brush

A brush member with a configuration similar to the primary transfer brush 14 can be used for the toner charging brush 40. In the present embodiment, a brush member with the following specifications is used for the toner charging brush 40 with representative characteristics.

Member type: pile fabric

Material of brush fibers: nylon fibers with dispersed carbon powder

Diameter of brush fibers: 27 μm

Resistivity of brush fibers: $10^9$ Ωcm

Length of fibers: 4 mm

Array density: 11200 fibers/$cm^2$

6. Definitions of Voltage, Potential and Current

Figure 5:
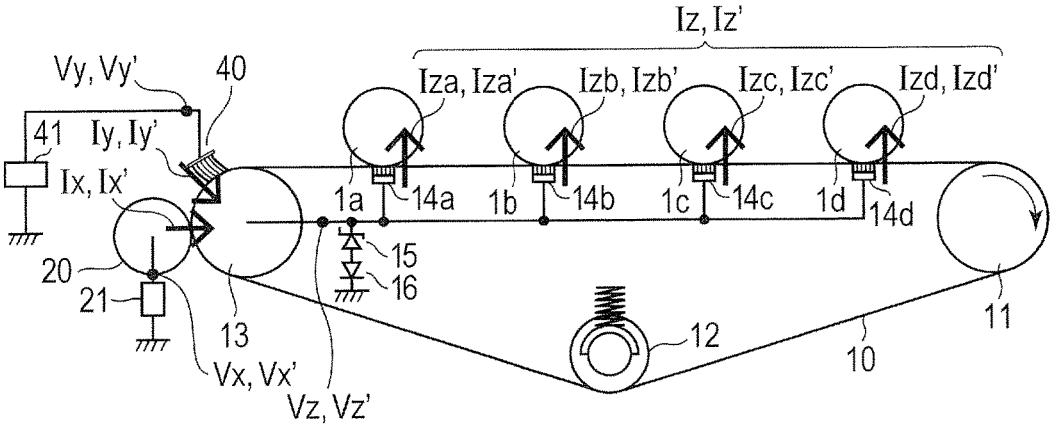
FIG. 5 is a schematic diagram for describing definitions of voltage, potential and current.

FIG. 5 is a schematic diagram for describing definitions of the voltage, the potential and the current of each component in the image forming apparatus 100 according to the present embodiment.

First, definitions of the voltage, the potential and the current during the image forming operation will be described. Although described in detail later, the "image forming operation" is an operation of primarily and secondarily transferring the toner image of the image to be transferred and output to the recording material P and collecting the secondary transfer residual toner of the image. "Vx" is a voltage applied from the secondary transfer power supply 21 to the secondary transfer roller 20 during the image forming operation (also referred to as "secondary transfer voltage" here). "Vy" is a voltage applied from the charge power supply 41 to the toner charging brush 40 during the image forming operation (also referred to as "toner charging voltage" here). "Vz" is a potential of the intermediate transferring belt 10 during the image forming operation (also referred to as "primary transfer potential" here). "Ix" is a current flowing from the secondary transfer roller 20 to the secondary transfer opposing roller 13 through the intermediate transferring belt 10 during the image forming operation (also referred to as "secondary transfer current" here). "Iy" is a current flowing from the toner charging brush 40 to the secondary transfer opposing roller 13 through the intermediate transferring belt 10 during the image forming operation (also referred to as "toner charge current" here). "Iz" is a current flowing from the primary transfer brush 14 to the photosensitive drum 1 through the intermediate transferring belt 10 during the image forming operation (also referred to as "primary transfer current" here). Note that "Iz" is a sum of "Iza", "Izb", "Izc" and "Izd" flowing in the image forming units Sa, Sb, Sc and Sd, respectively, and the values of "Iza", "Izb", "Izc" and "Izd" are substantially the same.

During the image forming operation in the present embodiment, $$Vx>0, Vy>0$$

hold, and as a result, $$Ix(>0), Iy(>0)$$

are obtained. In this case, due to the current flowing into the Zener diode 15, $$Vz=+700\ \text{V}$$

is maintained. Furthermore, $$Ix+Iy>Iz, Iz>0$$

are obtained.

Next, definitions of the voltage, the potential and the current in the recovery operation will be described. Although described in detail later, the "recovery operation" is an operation performed for preventing uneven distribution of ions (conductive agent) in the intermediate transferring belt 10 during the post-processing operation that is an example of the non-image forming period. "Vx'" is a secondary transfer voltage in the recovery operation. "Vy'" is a toner charging voltage in the recovery operation. "Vz'" is a primary transfer potential in the recovery operation. "Ix'" is a secondary transfer current in the recovery operation. "Iy'" is a toner charge current in the recovery operation. "Iz'" is a primary transfer current in the recovery operation. Note that "Iz'" is a sum of "Iza'", "Izb'", "Izc'" and "Izd'" flowing in the image forming units Sa, Sb, Sc and Sd, respectively, and the values of "Iza'", "Izb'", "Izc'" and "Izd'" are substantially the same.

In the recovery operation in the present embodiment, $$Vx'<0, Vy'<0$$

hold, and as a result, $$Ix'(<0), Iy'(<0)$$

are obtained. In this case, $$Vz'<0$$

holds. Since the diode 16 cuts off the current to the grounded location, $$Ix'+Iy'=Iz', Iz'<0$$

are obtained.

7. Operation Sequence

Figure 6:
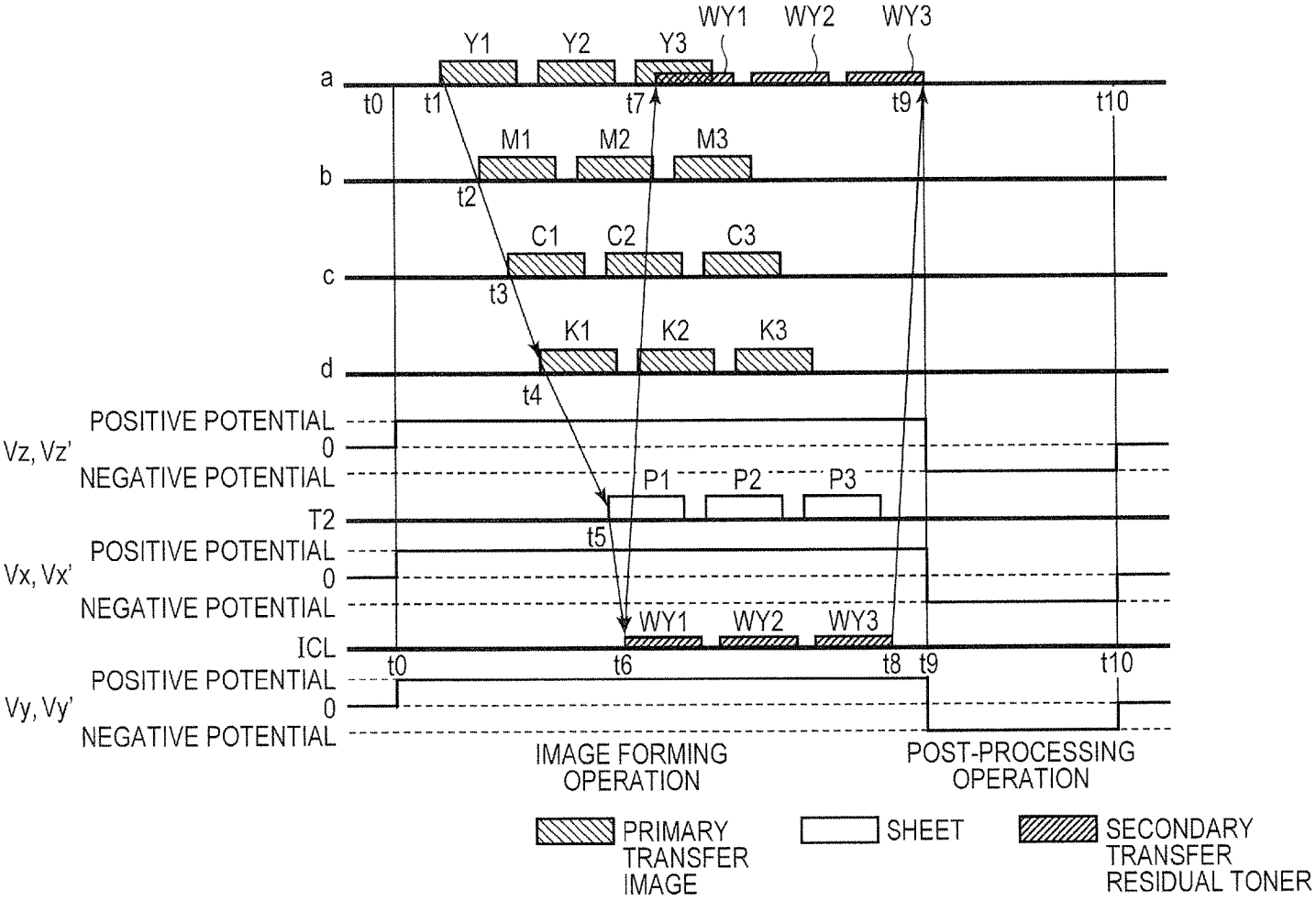
FIG. 6 is a timing chart according to the first embodiment (condition A).

Next, an operation sequence of the image forming apparatus 100 of the present embodiment will be described. FIG. 6 is a timing chart showing an operation sequence of continuous printing of three images. The control unit 50 controls the operation sequence. In FIG. 6, a, b, c and d indicate whether there is toner on the intermediate transferring belt 10 in the primary transfer sections T1*a*, T1*b*, T1*c* and T1*d* of the image forming units Sa, Sb, Sc and Sd. T2 indicates whether there is toner on the intermediate transferring belt 10 in the secondary transfer section T2. ICL indicates whether there is toner on the intermediate transferring belt 10 in the toner charge section Ch. Vx, Vy, Vz, Vx', Vy' and Vz' indicate the states of the voltages (potentials) described above.

7-1. Image Forming Operation

First, an operation sequence of the image forming operation will be described. When the print operation is started, Vx (+1700 V) and Vy (+2200 V) of positive polarity (positive value) are applied at time t0, and Ix (+16 μA) and Iy (+35 μA) of positive polarity start to flow. In this case, Ix and Iy flow into the Zener diode 15, and Vz is maintained at +700 V of the Zener voltage. Iza, Izb, Izc and Izd (+10 μA each) of positive polarity flow, providing Iz (+40 μA) of positive polarity. Iza primarily transfers the toner image from the photosensitive drum 1*a* to the intermediate transferring belt 10 at the primary transfer section Ta1 of the first image forming unit Sa. Y1, Y2 and Y3 in FIG. 6 indicate periods of the primary transfer of the first, second and third toner images in the first image forming unit Sa, respectively. The same applies to M1 to M3 for the second image forming unit Sb, C1 to C3 for the third image forming unit Sc, and K1 to K3 for the fourth image forming unit Sd.

Time t1 is a time of the start of the primary transfer of the first toner image at the primary transfer section T1*a* of the first image forming unit Sa. Between time t1 and time t2, the tip of the first toner image moves to the primary transfer section T1*b* of the second image forming unit Sb. More specifically, time t2 is a time that the tip of the first toner image reaches the primary transfer section T1*b* of the second image forming unit Sb. At time t2, the toner image of color M is started to be primarily transferred on top of the toner image of color Y. Similarly, time t3 and time t4 are times that the tip of the first toner image reaches the primary transfer sections T1*c* and T1*d* of the third and fourth image forming units Sc and Sd, respectively.

Time t5 is a time of the arrival of the tip of the first toner image at the second transfer section T2 and the start of the secondary transfer of the toner image from the intermediate transferring belt 10 to the transfer material P based on Ix. P1, P2 and P3 in FIG. 6 indicate periods of the secondary transfer of the first, second, and third toner images to the recording material P at the secondary transfer section T2, respectively. Time t6 is a time of the arrival of the secondary transfer residual toner of the first toner image at the toner charge section Ch and the start of the charging process based on Iy. At the toner charge section Ch, the secondary transfer residual toner is charged with a positive polarity that is a polarity opposite the regular charge polarity of the toner. WY1, WY2 and WY3 in the field of ICL in FIG. 6 indicate periods in which the toner charging brush 40 charges the secondary transfer residual toner of the first, second and third toner images at the toner charge section Ch.

Time t7 is a time that the secondary transfer residual toner of the first toner image charged by the toner charge section Ch reaches the primary transfer section T1*a* of the first image forming unit Sa again. Therefore, the intermediate transferring belt 10 rotates once between time t1 and time t7. In other words, the time period from time t1 to time t7 is a time period for the primarily transferred toner image to make a round as a secondary transfer residual toner and return to the same primary transfer section T1. WY1, WY2 and WY3 in the field of "a" in FIG. 6 respectively indicate periods that the secondary transfer residual toners of the first, second and third toner images reach the primary transfer section T1*a* of the first image forming unit Sa and are transferred to the photosensitive drum 1*a* charged with negative polarity. The cleaning apparatus 5*a* collects the secondary transfer residual toners transferred to the photosensitive drum 1*a*. When the potential Vz with the same polarity (positive polarity in the preset embodiment) as the secondary transfer residual toner is generated on the intermediate transferring belt 10 while the secondary transfer residual toner passes through the primary transfer section T1*a* of the first image forming unit Sa, the secondary transfer residual toner is transferred to the photosensitive drum 1*a* based on Iza.

Here, in the present embodiment, the secondary transfer residual toner is moved to the primary transfer section T1*a* in the primary transfer of the toner image in the period Y3 at the primary transfer section T1*a* of the first image forming unit Sa. In this case, the secondary transfer residual toner charged with polarity opposite the regular charge polarity on the intermediate transferring belt 10 and the toner charged with the regular charge polarity on the photosensitive drum 1*a* are hardly electrically neutralized at the primary transfer section (primary transfer nip section) T1*a*. Therefore, the toner charged with the regular charge polarity on the photosensitive drum 1*a* in the period Y3 moves to the intermediate transferring belt 10, and the toner charged with the polarity opposite the regular charge polarity on the intermediate transferring belt 10 in the period WY1 moves to the photosensitive drum 1*a*. In this way, the toner on the photosensitive drum 1 to be primarily transferred and the secondary transfer residual toner on the intermediate transferring belt 10 move independently from each other and are transferred and collected at the same time.

At time t8, the end of the secondary transfer residual toner of the third toner image passes through the toner charge section Ch. The secondary transfer residual toner is transferred to the photosensitive drum 1*a* before time t9, and the image forming operation is completed.

In the present embodiment, the operation in the period from time t0 to time t9 is the "image forming operation". Time t0 is the start of the formation of the electrostatic latent image of the first image in the print operation in the image forming unit Sa on the most upstream in the present embodiment. Time t9 is the end of the transfer of the secondary transfer residual toner of the last image in the print operation to the photosensitive drum 1*a* in the image forming unit Sa on the most upstream in the present embodiment. That is, time t9 is a time that the position, on the intermediate transferring belt 10, of the end of the toner image of the last image in the print operation passes through the primary transfer section T1 of the image forming unit Sa on the most upstream after one round of the intermediate transferring belt 10.

7-2 Recovery Operation

Next, an operation sequence of the recovery operation will be described. At time t9, Vx' (−1100 V) and Vy' (−1300 V) of negative polarity (negative value) are applied, and Ix' (−5.5 μA) and Iy' (−8 μA) of negative polarity start to flow. In this case, Ix' and Iy' do not go out to the grounded location due to the action of the diode 16, but flow into the primary transfer sections T1*a*, T1*b*, T1*c* and T1*d*. Therefore, the voltage is applied to the Zener diode 15 in the forward direction, and there is no potential difference between both ends. On the other hand, a reverse voltage is applied to the diode 16 in the forward direction, and the current does not flow between the diode 16 and the grounded location. Therefore, Vz' has a negative polarity, and the total current of Ix' and Iy' is divided into Iza', Izb', Izc' and Izd' (−3.375 μA each) of negative polarity, providing Iz' (−13.5 μA) of negative polarity. In this case, a potential difference exceeding about 500 V that is a discharge start potential difference is formed between the primary transfer brushes 14*a*, 14*b*, 14*c* and 14*d* and the photosensitive drums 1*a*, 1*b*, 1*c* and 1*d*, respectively. This state continues until time t10 which is a predetermined time period after time t9, that is, three seconds after time t9 in the present embodiment. Vx' and Vy' are turned off and become 0 V at time t10, and Vz' also becomes 0 V. Although the time period from time t9 to time t10 can be appropriately set to sufficiently prevent the uneven distribution of ions (conductive agent) in the intermediate transferring belt 10, the time period can be equivalent to about one to three rounds of the intermediate transferring belt 10. In the present embodiment, the time period is set to a time period substantially equal to about one round of the intermediate transferring belt 10.

In the present embodiment, the operation in the period from the start to the end of the application of Vx' and Vy' of negative polarity (period from time t9 to time t10) is the "recovery operation". In the present embodiment, the recovery operation is executed during the post-processing operation that is an example of the non-image forming period. Particularly, the recovery operation is executed during the post-processing operation of every print operation (job) in the present embodiment. Therefore, every time the job is executed, the control unit 50 executes the recovery operation after the end of the primary transfer in the job in the present embodiment. However, the operation is not limited to this, and the recovery operation may be executed every multiple times of print operation as long as the uneven distribution of ions in the intermediate transferring belt 10 can be sufficiently prevented. The recovery operation can also be executed during the interleaving, during the preprocessing operation or during the pre-multi-rotation operation as long as the recovery operation is in the non-image forming period.

The primary transfer current Iz of positive polarity during the image forming operation moves the anion in the intermediate transferring belt 10 to the back surface side of the intermediate transferring belt 10 not provided with the surface layer 10B. However, even when the anion moves in this way, the primary transfer current Iz' of negative polarity in the recovery operation returns the anion to the surface side of the intermediate transferring belt 10. This can prevent the uneven distribution of ions in the intermediate transferring belt 10.

The effect of the recovery operation can prevent the uneven distribution of the conductive agent in the intermediate transferring belt 10. This prevents an increase in the electric resistance of the primary transfer brush 14 caused by precipitation of the anion on the back surface side of the intermediate transferring belt 10 and adherence of the anion to the surface of the primary transfer brush 14. For example, even when a print operation for continuous printing of three images is repeated to output a total of 6000 images, an increase in the electric resistance of the primary transfer brush 14 caused by precipitation of the anion and adherence of the anion to the surface of the primary transfer brush 14 can be prevented (test results will be described later). As a result, appropriate primary transfer current Iz can be secured during the image forming operation, and a good primary transferability can be continuously obtained.

The secondary transfer current Ix and the toner charge current Iy of positive polarity during the image forming operation also move the anion in the intermediate transferring belt 10 to the surface side of the intermediate transferring belt 10. However, the moved anion is blocked by the highly airtight surface layer 10B in the present embodiment, and the anion is unlikely to precipitate on the surface side of the intermediate transferring belt 10.

When the entire intermediate transferring belt 10 is viewed from the macro point of view, it can also be considered that the movement of the anion to the surface side of the intermediate transferring belt 10 during the image forming operation tends to prevent the movement of the anion to the back surface side of the intermediate transferring belt 10 that causes a problem at the primary transfer section T1. However, the primary transfer brush 14 in contact with the backside surface of the intermediate transferring belt 10, the secondary transfer roller 20 in contact with the surface, and the toner charging brush 40 also in contact with the surface come into contact with the intermediate transferring belt 10 in different nip shapes. In the present embodiment, the primary transfer brush 14 includes relatively thin fibers and makes a contact in a point-contact manner. The secondary transfer roller 20 includes a foam surface and makes a contact in a pattern of the texture of surface cells. The toner charging brush 40 includes relatively thick fibers and makes a contact in a point shape a little larger than the primary transfer brush 14. Therefore, from the micro point of view, the movements of the ions in the intermediate transferring belt 10 caused by the members can be considered as independent phenomena in small areas of the shapes of the members coming into contact with the intermediate transferring belt 10 in the nips. Therefore, the movement of the anion to the surface side of the intermediate transferring belt 10 and the movement of the anion to the back surface side of the intermediate transferring belt 10 during the image forming operation may not always tend to cancel each other and are problems to be independently controlled. Even if the contact member, the secondary transfer member and the charge member have substantially the same configurations, the members usually do not cause movements of ions in completely matching areas from the micro point of view, and the situation is the same as in the present embodiment.

In this way, the control unit 50 in the present embodiment executes the following recovery operation when the primary transfer is not performed (during the post-processing operation in the present embodiment). In the recovery operation, the secondary transfer roller 20 and the toner charging brush 40 supply current, which is in a direction opposite the direction in the primary transfer, to the primary transfer brush 14 through the secondary transfer opposing roller 13. The uneven distribution of the conductive agent in the intermediate transferring member caused by the primary transfer is then alleviated. Particularly, the recovery operation is executed after the primary transfer and after the end of the transfer of the secondary transfer residual toner to the photosensitive drum 1 in the present embodiment.

8. Check of Effects 8-1. Operation Sequence

Image levels in the present embodiment and comparative examples are investigated to check the effects of the recovery operation. In operation sequences of the comparative examples, the part of the image forming operation in the operation sequence of the present embodiment is not changed, and only the part of the post-processing operation is changed. Specifically, Ix' and Iy' in the post-processing operation are changed to change Iz' obtained as a total current of Ix' and Iy'. Table 1 shows conditions of the operation sequences and results of checking the image levels.

TABLE 1

| | Condition | | A | B | C | D |
|---|---|---|---|---|---|---|
| During Post-Processing Operation | Setting of Current | Ix' | −5.5 | −17.5 | 4.0 | 4.0 |
| | | Iy' | −8.0 | 4.0 | −17.5 | 4.0 |
| | | Iz' | −13.5 | −13.5 | −13.5 | 8.0 |
| During Image Forming Operation (After Continuous Printing) | Current Image | Iz Level | 40 | 40 | 40 | 20 |
| | | | Good | Good | Good | Primary Transfer Failure |

A condition A indicates the operation sequence of the present embodiment, and conditions B, C and D indicate the operation sequences of the comparative examples. Among these, the conditions A, B and C indicate operation sequences according to the present invention, and the condition D indicates an operation sequence not following the present invention.

Figure 7:
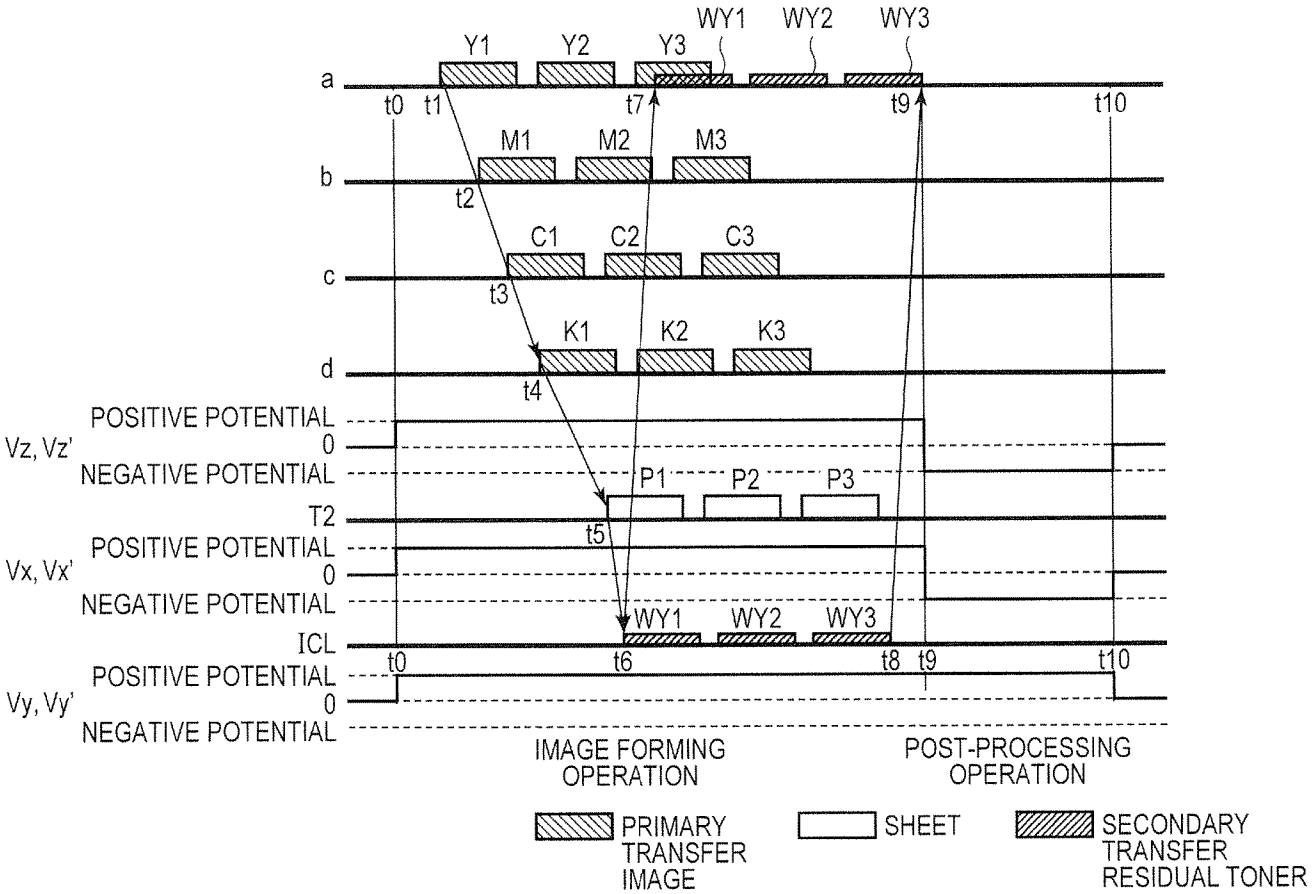
FIG. 7 is a timing chart according to a comparative example (condition B).

The operation sequence of the condition A is as shown in FIG. 6. The condition B is an operation sequence shown in FIG. 7. The difference between the condition A (Iy' is negative) and the condition B (Iy' is positive) is as follows. When, for example, an image with a high printing rate (image area ratio) is output, part of the secondary transfer residual toner may stay on the toner charging brush 40 during the image forming operation. The staying secondary transfer residual toner is charged with negative polarity. Therefore, when Iy' is negative as in the condition A, that is, when Vy' of negative polarity is applied, the toner charged with negative polarity moves from the toner charging brush 40 to the intermediate transferring belt 10 in the recovery operation. The toner charged with negative polarity moved to the intermediate transferring belt 10 is transferred to the photosensitive drum 1*a* of the first image forming unit Sa because Iz' is negative, and the cleaning apparatus 5*a* collects the toner. Therefore, the condition A also has an effect of discharging the toner staying in the toner charging brush 40 to the intermediate transferring belt 10 in the recovery operation to maintain the charge performance of the toner for a long time. On the other hand, when Iy' is positive as in the condition B, that is, when Vy' of positive polarity is applied, the secondary transfer residual toner charged with negative polarity staying in the toner charging brush 40 can be kept in the toner charging brush 40 in the recovery operation. The condition B is effective when, for example, the recovery operation is shortened as much as possible, and an operation of discharging the toner from the toner charging brush 40 is separately performed. Therefore, the condition B can prevent a phenomenon that the toner moved from the toner charging brush 40 to the intermediate transferring belt 10 in the recovery operation is not transferred to the photosensitive drum 1 and appears as toner stains on the recording material P in the next print operation.

Figure 8:
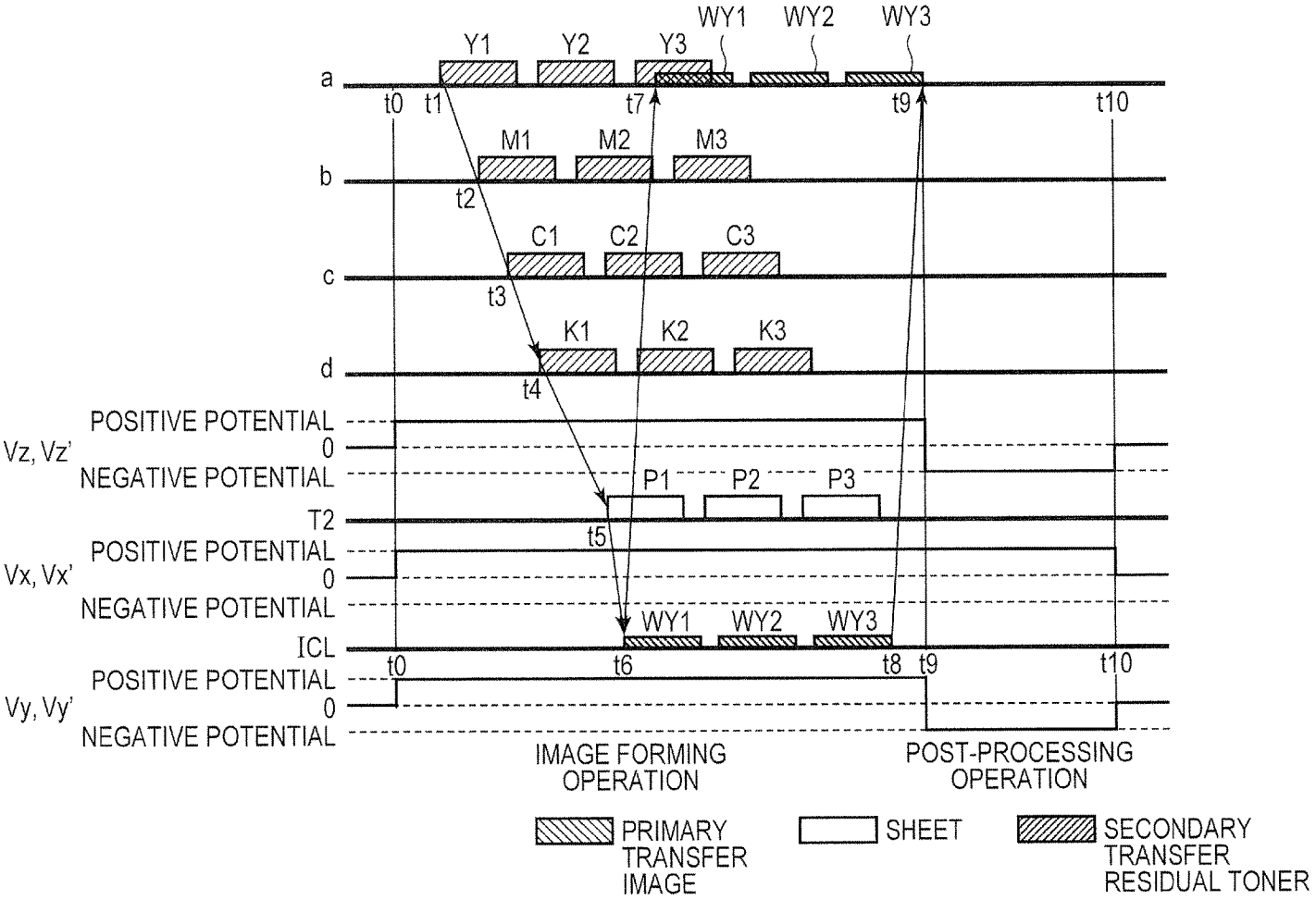
FIG. 8 is a timing chart according to a comparative example (condition C).

The condition C is an operation sequence shown in FIG. 8. The difference between the condition A (Ix' is negative) and the condition C (Ix' is positive) is as follows. When, for example, the development apparatus 4 with a long use history, that is, a large total number of prints, is used to output an image, so-called fog toner may adhere to the secondary transfer roller 20 during the image forming operation. The fog toner adheres to an unexposed part on the photosensitive drum 1, that is, a non-image area. Part of the fog toner is transferred to the intermediate transferring belt 10 and further moves to the secondary transfer roller 20. The fog toner is charged with negative polarity. Therefore, when Ix' is negative as in the condition A, that is, when Vx' of negative polarity is applied, the toner charged with negative polarity moves from the secondary transfer roller 20 to the intermediate transferring belt 10 in the recovery operation. The toner charged with negative polarity moved to the intermediate transferring belt 10 passes through the toner charge section Ch because Iy' is negative. The passed toner charged with negative polarity is transferred to the photosensitive drum 1*a* of the first image forming unit Sa because Iz' is negative, and the cleaning apparatus 5*a* collects the toner. Therefore, the condition A also has an effect of moving the toner adhered on the secondary transfer roller 20 to the intermediate transferring belt 10 in the recovery operation and cleaning the secondary transfer roller 20. On the other hand, when Ix' is positive as in the condition C, that is, when Vx' of positive polarity is applied, the fog toner charged with negative polarity adhered on the secondary transfer roller 20 can be kept in the secondary transfer roller 20 in the recovery operation, as described above. The condition C is effective when, for example, the recovery operation is shortened as much as possible, and the cleaning operation of the secondary transfer roller 20 is separately performed. Therefore, the condition C can prevent a phenomenon that the toner moved from the secondary transfer roller 20 to the intermediate transferring belt 10 in the recovery operation is not transferred to the photosensitive drum 1 and appears as toner stains on the recording material P in the next print operation.

Figure 9:
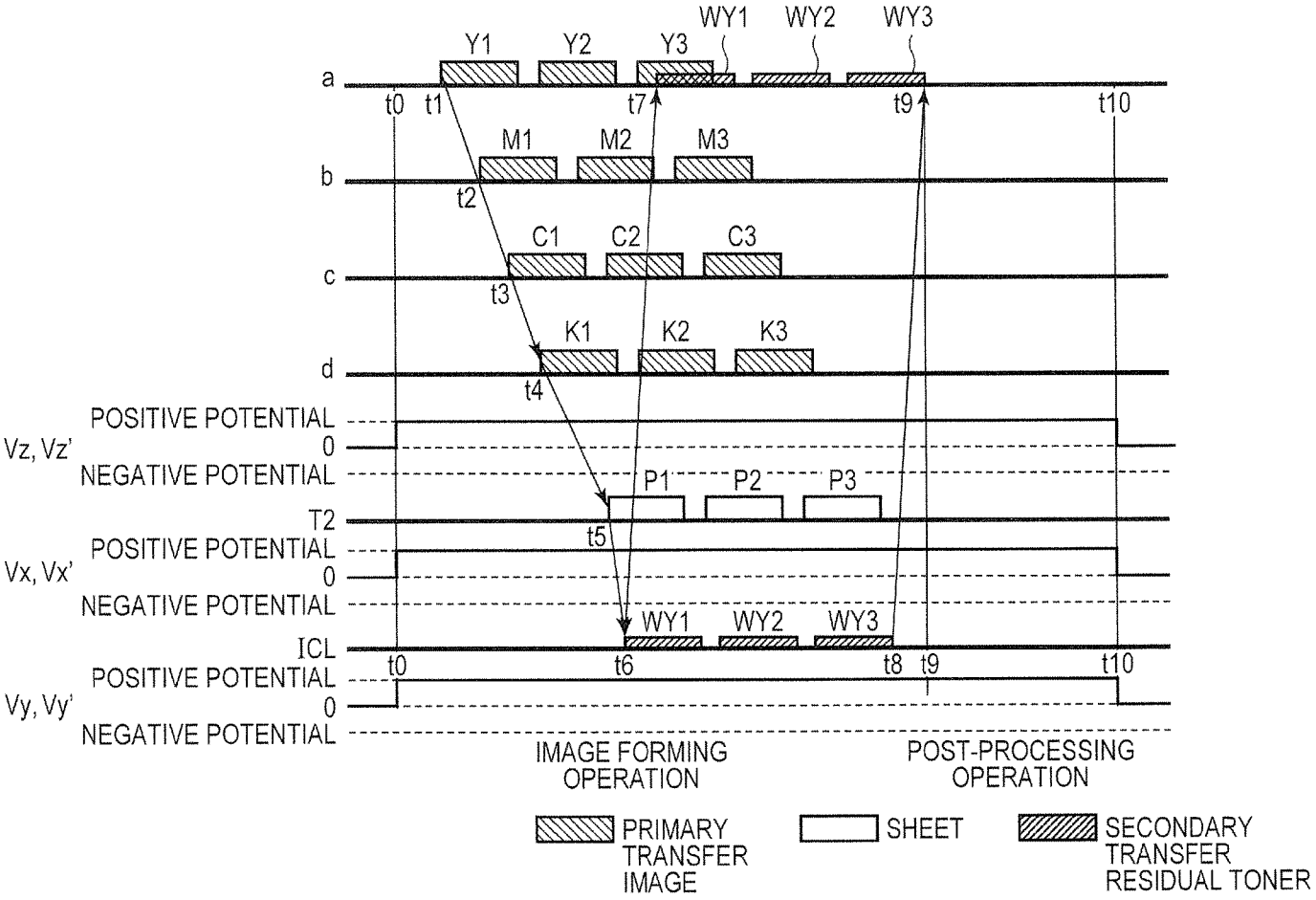
FIG. 9 is a timing chart according to a comparative example (condition D).

The condition D is an operation sequence shown in FIG. 9. In the condition D, the recovery operation according to the present invention is not executed during the post-processing operation.

8-2. Test Results

The print operation of performing continuous printing of three images is repeated under the conditions A to D to investigate the image levels after the output of 6000 images in total. For the image levels, whether there is a primary transfer failure due to insufficient primary transfer current is checked. The image level is "good" when there is no primary transfer failure, and the image level is "bad" when there is a primary transfer failure.

As shown in Table 1, good image levels are obtained under the conditions A, B and C. Iz during the image forming operation is maintained substantially at 40 μA from the beginning to the end of the test.

On the other hand, there is a primary transfer failure under the condition D as shown in Table 1.

Specifically, the toner cannot be detached from the photosensitive drum 1 and cannot be transferred to the intermediate transferring belt 10. There are uneven images in solid images and the like. Iz in the image forming operation decreases to 20 μA at the end of the test that is about a half the level at the beginning of the test. Under the condition D, the uneven distribution of the conductive agent in the intermediate transferring belt 10 cannot be sufficiently prevented, and the anion is precipitated on the back surface side of the intermediate transferring belt 10. The anion adheres the surface of the primary transfer brush 14, and the electric resistance of the primary transfer brush increases. Therefore, it can be considered that Iz decreases, and the primary transfer performance is deteriorated.

In this way, since Iz' is −13.5 μA under the conditions A, B and C, the uneven distribution of the conductive agent in the intermediate transferring belt 10 can be prevented, and the precipitation of ions in the intermediate transferring belt 10 can be favorably prevented. On the other hand, since Iz' is 8 μA under the condition D, the uneven distribution of the conductive agent in the intermediate transferring belt 10 cannot be sufficiently prevented, and the ions in the intermediate transferring belt 10 are precipitated. According to the experiment by the present inventors, the absolute value of Iz' in the recovery operation can be equal to or greater than 10% and equal to or smaller than 60% of the absolute value of Iz during the image forming operation in order to sufficiently prevent the uneven distribution of the conductive agent in the intermediate transferring belt 10.

9. Summary

As described, the image forming apparatus 100 in the present embodiment includes the secondary transfer roller 20 and the toner charging brush 40 that are in contact with the surface of the ionically conductive intermediate transferring belt 10 including the surface layer 10B. The image forming apparatus 100 applies voltage to the secondary transfer roller 20 and the toner charging brush 40 and supplies the current Iz to the primary transfer brush 14 through the secondary transfer opposing roller 13 to perform the primary transfer. In the post-processing operation of the print operation, the image forming apparatus 100 performs the recovery operation of supplying the primary transfer brush 14 with the current Iz' with polarity opposite (opposite direction) the polarity during the image forming operation. Particularly, in the present embodiment (condition A), voltages with the same polarity are applied to the secondary transfer roller 20 and the toner charging brush 40 during the image forming operation and in the recovery operation. However, voltages with different polarities may be applied to a plurality of current supply members, such as the secondary transfer roller 20 and the toner charging brush 40, in the recovery operation as in the conditions B and C. In that case, the polarities (directions) of the total currents supplied to the primary transfer brush 14 during the image forming operation and in the recovery operation can be controlled to be opposite polarities (opposite directions).

According to the configuration of the present embodiment, the ions (conductive agent) moved to the back surface side of the intermediate transferring belt 10 during the image forming operation are returned to the surface side of the intermediate transferring belt 10 in the recovery operation. This prevents uneven distribution of the conductive agent in the intermediate transferring belt 10. As a result, the ions in the intermediate transferring belt 10 are precipitated and stuck to the surface of the primary transfer brush 14. This prevents an increase in the electric resistance of the primary transfer brush 14. Therefore, a good primary transferability can be continuously obtained.

Second Embodiment

Next, another embodiment of the present invention will be described. Basic configuration and operation of the image forming apparatus of the present embodiment are the same as in the first embodiment. Therefore, in the image forming apparatus of the present embodiment, the same reference signs as in the first embodiment are provided to the elements with the same or corresponding functions or configurations as in the first embodiment, and the detailed description will not be repeated.

The present embodiment is different from the first embodiment in that the absolute value of Iz' flowing in the recovery operation is adjusted according to a detection result of an atmospheric environment detected by an environment sensor.

Figure 10:
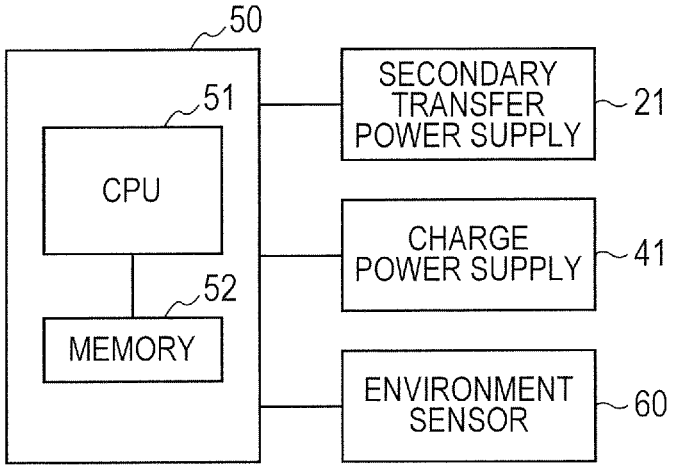
FIG. 10 is a block diagram illustrating a control mode of main parts of the image forming apparatus according to a second embodiment.

FIG. 10 is a block diagram illustrating a control mode of main parts of the image forming apparatus 100 according to the present embodiment. In the present embodiment, the image forming apparatus 100 includes an environment sensor 60 that detects the temperature and the humidity of the atmospheric environment of the image forming apparatus 100, the environment sensor 60 serving as an environment detection device that detects at least one of the temperature and the humidity of at least one of the inside and the outside of the apparatus body. In executing the print operation, the control unit 50 acquires the detection result of the environment sensor 60 at least before the start of the recovery operation. The control unit 50 then determines Ix', Iy' and Iz' in the recovery operation based on information associating environment information and conditions of the recovery operation stored and set in advance in the memory 52.

Table 2 shows the setting of Ix', Iy' and Iz' in the recovery operation for each environment in the present embodiment. Note that the setting of the voltage, the potential and the current during the image forming operation is the same as in the first embodiment. In the present embodiment, a condition of an NN environment described below is the same as the condition A of the first embodiment.

TABLE 2

| | Environment | HH | NN | LL |
|---|---|---|---|---|
| Setting of Current | Ix' | −5.0 | −5.5 | −4.1 |
| | Iy' | −4.2 | −8.0 | −14.0 |
| | Iz' | −9.2 | −13.5 | −18.1 |

An HH environment in the present embodiment is an environment in which the temperature is higher than 25° C., and the relative humidity is higher than 60% Rh. The NN environment in the present embodiment is an environment in which the temperature is higher than 20° C. and equal to or lower than 25° C., and the relative humidity is higher than 30% Rh and equal to or lower than 60% Rh. An LL environment in the present embodiment is an environment in which the temperature is equal to or lower than 20° C., and the relative humidity is equal to or lower than 30% Rh.

The print operation for performing continuous printing of three images is repeated in each of the HH environment (particularly, 30° C./80% Rh), the NN environment (particularly, 23° C./50% Rh) and the LL environment (particularly, 15° C./10% Rh). The image levels after the output of 6000 images in total are investigated. The evaluation method of the image levels is the same as the method described in the first embodiment.

As a result, good image levels are obtained from the beginning to the end of the test under all of the HH environment, the NN environment and the LL environment. Iz during the image forming operation is maintained substantially at 40 μA from the beginning to the end of the test.

The reason that the absolute value of Iz' in the recovery operation is smaller in a high temperature and high humidity environment and larger in a low temperature and low humidity environment is as follows. The mobility of ions in the intermediate transferring belt 10 is higher in the high temperature and high humidity environment and lower in the low temperature and low humidity environment. In the present embodiment, the anion in the intermediate transferring belt moved to the back surface side of the intermediate transferring belt 10 due to the primary transfer current Iz of positive polarity during the image forming operation is returned to the surface side of the intermediate transferring belt 10 through the primary transfer current Iz' of negative polarity in the recovery operation. Therefore, to return the anion to the surface side of the intermediate transferring belt 10 in the recovery operation in a predetermined time period, more current needs to be applied in the recovery operation under the low temperature and low humidity environment than under the high temperature and high humidity environment to easily move the ions.

In this way, the control unit 50 in the present embodiment changes the current supplied to the primary transfer brush 14 in the recovery operation based on the detection result of the environment detection device. Although the condition of the recovery operation is changed based on the temperature and the relative humidity of the environment in the present embodiment, the mobility of ions in the intermediate transferring belt 10 may be sufficiently correlated with at least one of the temperature and the humidity. Therefore, the condition of the recovery operation can be changed based on at least one of the temperature and the humidity of the environment. More specifically, based on the temperature or the humidity of the environment indicated by the detection result of the environment detection device, the control unit 50 can change the current supplied to the primary transfer brush 14 in the recovery operation to satisfy at least one of the following conditions. First, the absolute value of the current supplied in the recovery operation at a second temperature lower than a first temperature is larger than the absolute value of the current supplied in the recovery operation at the first temperature. Second, the absolute value of the current supplied in the recovery operation at a second humidity lower than a first humidity is larger than the absolute value of the current supplied in the recovery operation at the first humidity.

As described, the image forming apparatus 100 in the present embodiment controls and adjusts the absolute value of Iz' that flows in the recovery operation according to the detection result of the atmospheric environment detected by the environment sensor 60. As a result, according to the present embodiment, a good primary transferability can be continuously obtained regardless of the environment.

Third Embodiment

Next, yet another embodiment of the present invention will be described. Basic configuration and operation of the image forming apparatus of the present embodiment are the same as in the first and second embodiments. Therefore, in the image forming apparatus of the present embodiment, the same reference signs as in the first embodiment are provided to the elements with the same or corresponding functions or configurations as in the first embodiment, and the detailed description will not be repeated.

The image forming apparatus 100 of the present embodiment is different from the first and second embodiments in that the intermediate transferring belt 10 includes a backside surface layer instead of the surface layer.

Figure 11:
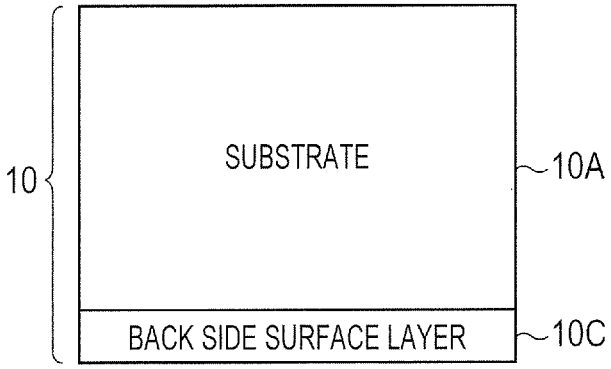
FIG. 11 is a schematic cross-sectional view of the intermediate transferring member according to a third embodiment.

FIG. 11 is a schematic cross-sectional view of the intermediate transferring belt 10 according to the present embodiment. In the present embodiment, the intermediate transferring belt 10 includes the base layer (substrate) 10A and a backside surface layer 10C. The base layer 10A is the same as in the first and second embodiments. The backside surface layer 10C is a layer in which the same layer as the surface layer 10B in the first and second embodiments is arranged on the back surface side of the base layer 10A instead of the surface side. Therefore, the backside surface layer 10C provided closer to the inner peripheral surface of the intermediate transferring belt 10 than the base layer 10A is in contact with the stretching members, such as the secondary transfer opposing roller 13, and with the primary transfer brush 14 in the present embodiment. The base layer 10A is in contact with the secondary transfer roller 20 and the toner charging brush 40 in the present embodiment.

In the present embodiment, control is performed to prevent precipitation of the ionic conductive agent on the surface side of the intermediate transferring belt 10 instead of the back surface side. More specifically, as described in the first embodiment, the secondary transfer current Ix of positive polarity and the toner charge current Iy of positive polarity during the image forming operation move the anion in the intermediate transferring belt 10 to the surface side of the intermediate transferring belt 10. The surface layer 10B is not provided in the present embodiment unlike in the first and second embodiments, and the moved anion tends to easily precipitate on the surface side of the intermediate transferring belt 10. When the anion adheres the surface of the secondary transfer roller 20, the electric resistance of the secondary transfer roller 20 increases. An appropriate transfer current cannot be obtained, and the secondary transferability decreases. When the anion adheres the surface of the toner charging brush 40, the electric resistance of the toner charging brush 40 increases, and the charge property of the secondary transfer residual toner decreases. When the electric resistances of the secondary transfer roller 20 and the toner charging brush 40 increase, the current supply member may not be able to supply an appropriate current, and the primary transferability may decreases.

Therefore, a recovery operation is executed in the present embodiment to supply a current with polarity opposite the polarity during the image forming operation to the secondary transfer roller 20 and the toner charging brush 40 in the post-processing operation. In this way, the uneven distribution of the conductive agent in the intermediate transferring belt 10 is prevented. This prevents an increase in the electric resistance of the secondary transfer roller 20 and the toner charging brush 40 caused by precipitation of the ions in the intermediate transferring belt 10 on the surface side of the intermediate transferring belt 10 and adherence of the ions to the surfaces of the secondary transfer roller 20 and the toner charging brush 40. In the present embodiment, the absolute values of Ix' and Iy' that flow in the recovery operation are adjusted according to the detection result of the atmospheric environment detected by the environment sensor 60 as in the second embodiment.

In the present embodiment, the primary transfer current Iz of positive polarity during the image forming operation also moves the anion in the intermediate transferring belt 10 to the back surface side of the intermediate transferring belt 10 as in the first and second embodiments. However, the moved anion is blocked by the highly airtight backside surface layer 10C in the present embodiment, and the anion is unlikely to precipitate on the back surface side of the intermediate transferring belt 10. The movements of the anions to the surface side and the back surface side of the intermediate transferring belt 10 during the image forming operation due to the difference in the nip shapes are problems to be independently controlled, and this is as described in the first embodiment.

Table 3 shows setting of Ix', Iy' and Iz' in the recovery operation in each environment according to the present embodiment. Note that the setting of the voltage, the potential and the current during the image forming operation is the same as in the first embodiment.

TABLE 3

| | Environment | HH | NN | LL |
|---|---|---|---|---|
| Setting of Current | Ix' | −3.6 | −5.5 | −7.2 |
| | Iy' | −8.0 | −12.0 | −15.8 |
| | Iz' | −11.6 | −17.5 | −23.0 |

The print operation of continuous printing of three images is repeated in each of the HH environment (particularly 30° C./80% Rh), the NN environment (particularly, 23° C./50% Rh) and the LL environment (particularly 15° C./10% Rh). The image level (secondary transferability) and the cleaning property (toner charging property) after outputting 6000 images in total are investigated. The evaluation method of the image level is the same as the method described in the first embodiment. As for the cleaning property, whether there are stains is checked, the stains caused by the secondary transfer residual toner remaining on the intermediate transferring belt 10 without being collected by the photosensitive drum 1 due to a lack of charge and adheres on the recording material P during the following print operation. The cleaning property is "good" if there are no stains, and the cleaning property is "bad" if there are stains.

As a result, good image level (secondary transferability) and cleaning property (toner charging property) are obtained from the beginning to the end of the test under each of the HH environment, the NN environment and the LL environment. Ix and Iy during the image forming operation are maintained substantially at 16 μA and 35 μA, respectively, from the beginning to the end of the test.

According to the experiment by the present inventors, the absolute values of Ix' and Iy' in the recovery operation can be equal to or greater than 10% and equal to or smaller than 60% of the absolute values of Ix and Iz during the image forming operation, respectively, to sufficiently prevent the uneven distribution of the conductive agent in the intermediate transferring belt 10.

The reason that the absolute values of Ix' and Iy' in the recovery operation are smaller in the high temperature and high humidity environment and larger in the low temperature and low humidity environment is as follows. The mobility of ions in the intermediate transferring belt 10 is larger in the high temperature and high humidity environment and smaller in the low temperature and low humidity environment. In the present embodiment, the anion in the intermediate transferring belt 10 moved to the surface side of the intermediate transferring belt 10 due to Ix and Iy of positive polarity during the image forming operation is returned to the back surface side of the intermediate transferring belt 10 based on Ix' and Iy' of negative polarity in the recovery operation. Therefore, to return the anion to the back surface side of the intermediate transferring belt 10 in the recovery operation in a predetermined time period, more current needs to be applied in the recovery operation under the low temperature and low humidity environment than under the high temperature and high humidity environment to easily move the ions.

In this way, the control unit 50 in the present embodiment executes the recovery operation of supplying the secondary transfer roller 20 and the toner charging brush 40 with currents in the direction opposite the direction in the primary transfer. In the present embodiment, the polarities of the voltages applied to the secondary transfer roller 20 and the toner charging brush 40 in the recovery operation are the same polarity (polarity opposite the polarity in the primary transfer). In the present embodiment, the control unit 50 changes the currents supplied to the secondary transfer roller 20 and the toner charging brush 40 in the recovery operation based on the detection result of the environment detection device. In this case, the magnitude relationship between the currents supplied to the secondary transfer roller 20 and the toner charging brush 40 with respect to the temperature and the humidity is the same as the magnitude relationship between the currents supplied to the primary transfer brush 14 with respect to the temperature and the humidity described in the second embodiment.

As described, the image forming apparatus 100 in the present embodiment includes the intermediate transferring belt 10 including the backside surface layer 10C and not including the surface layer 10B. During the post-processing operation of the print operation, the image forming apparatus 100 in the present embodiment executes the recovery operation of supplying the secondary transfer roller 20 and the toner charging brush 40 with the currents Ix' and Iy' with polarity (opposite direction) opposite the polarity during the image forming operation. In the present embodiment, the control is performed to adjust the absolute values of Ix' and Iy' that flow in the recovery operation. As a result, according to the present embodiment, good secondary transferability and toner charging property can be continuously obtained regardless of the environment.

Although the condition of the recovery operation is changed in the present embodiment according to the detection result of the atmospheric environment as in the second embodiment, the recovery operation can be performed without performing the change.

In the present embodiment, the polarity of Iz' in the recovery operation is also opposite the polarity of Iz during the image forming operation. Therefore, according to the recovery operation of the present embodiment, the precipitation of the ions on the back surface side of the intermediate transferring belt 10 can be properly prevented by the recovery operation as in the first and second embodiments even if the backside surface layer 10C is not provided on the intermediate transferring belt 10. Similarly, the polarities of Ix' and Iy' in the recovery operation are respectively opposite the polarities of Ix and Iy during the image forming operation in the first embodiment (condition A). Therefore, according to the recovery operation of the first embodiment, the precipitation of the ions on the surface side of the intermediate transferring belt 10 is properly prevented by the recovery operation as in the present embodiment even if the surface layer 10B is not provided on the intermediate transferring belt 10.

[Others]

Although the present invention has been described along with specific embodiments, the present invention is not limited to the embodiments.

Figure 12:
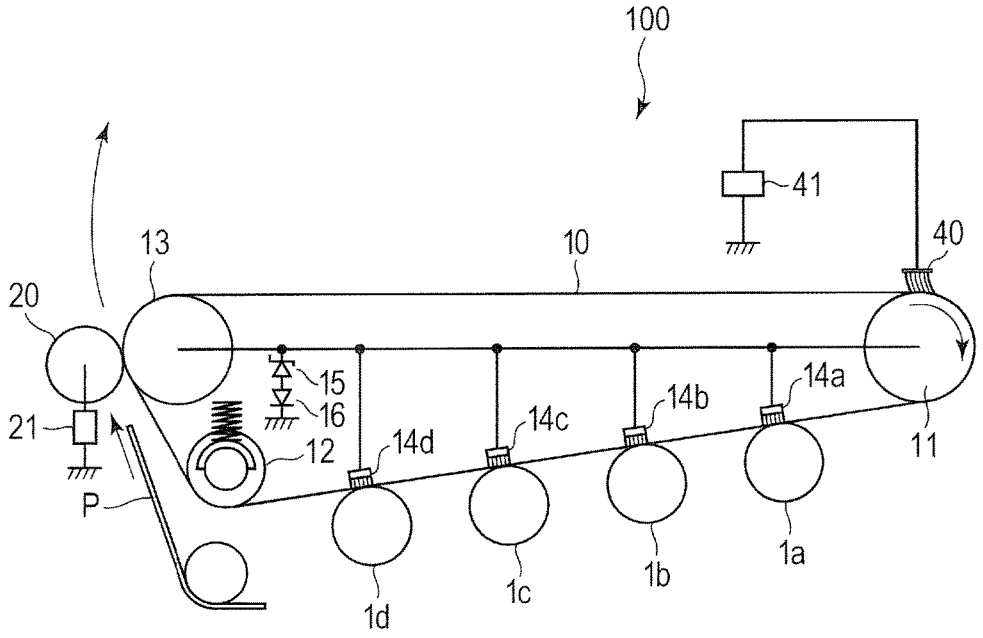
FIG. 12 is a schematic cross-sectional view of another embodiment of the image forming apparatus.

Although the photosensitive drum is arranged above the intermediate transferring member in the image forming apparatus in the embodiments described above, the present invention is not limited to the mode. FIG. 12 is a schematic cross-sectional view of main parts of another example of the image forming apparatus in which the present invention can be applied. In the image forming apparatus of FIG. 12, the same reference signs are provided to the elements with the same or corresponding functions or configurations as in the image forming apparatus of FIG. 1. The photosensitive drum 1 is arranged below the intermediate transferring belt 10 in the image forming apparatus 100 of FIG. 12. In the image forming apparatus 100 of FIG. 12, the opposing member (first opposing member) of the secondary transfer roller 20 is the secondary transfer opposing roller 13, and the opposing member (second opposing member) of the toner charging brush 40 is the drive roller 11. In this case, the current with polarity opposite the polarity during the image forming operation can be applied to the contact member (see the first and second embodiments) or the secondary transfer member and the charge member (see the third embodiment) in the recovery operation to obtain the same effects as in the embodiments. In this way, the opposing members may be a common member facing both the secondary transfer member and the charge member through the intermediate transferring member or may be separate members facing the secondary transfer member and the charge member, respectively, through the intermediate transferring member.

Although the voltages are applied to the secondary transfer member and the charge member from independent power supplies in the embodiments, a common power supply may apply the voltages when voltages of the same polarity are applied in synchronization with the secondary transfer member and the charge member.

In the embodiments, the image forming apparatus collects the secondary transfer residual toner on the intermediate transfer member through electrostatic cleaning (cleaning at the same time as the primary transfer), and the charge member is used as a current supply member. However, the present invention is not limited to this, and the image forming apparatus may not include the charge member and the charge power supply when a belt cleaning apparatus of a blade cleaning system is provided. In this case, the secondary transfer member can be used as a current supply member. The current supply member may be provided in addition to the secondary transfer member and the charge member or may be specially provided in place of the secondary transfer member and the charge member.

The contact member is not limited to the brush-like member, and the contact member may be a roller-like member, such as an elastic roller and a metal roller, a sheet-like member or a block-like (pad-like) member. Similarly, the current supply member also serving as the secondary transfer member or the charge member or the specifically provided current supply member may have an appropriate arbitrary form, such as a brush shape, a sheet shape, a roller shape and a block shape (pad shape).

The constant voltage element is used as the voltage maintaining element in the embodiments. As a result, a voltage greater than a predetermined value can be applied to the current supply member to maintain the potential of the intermediate transfer member at a predetermined potential. However, the element is not limited to this, and a member with a sufficiently high resistance (resistance element) may be used as the voltage maintaining element. In this case, a sufficiently high voltage can be applied to the current supply member to maintain the potential of the intermediate transfer member at a potential according to the voltage applied to the current supply member and the electric resistance value of the resistance member. In this way, the image forming apparatus can be electrically connected to the contact member and the opposing member and can include the voltage maintaining element that maintains the contact member at a potential equal to or greater than a predetermined potential when the current is supplied from the current supply member to the contact member through the opposing member in the primary transfer.

The image forming apparatus of the present invention can prevent a transfer failure caused by uneven distribution of a conductive agent in a member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-235234, filed Dec. 2, 2016, which is hereby incorporated by reference herein in its entirety.

What is claimed is:

1. An image forming apparatus comprising:

an image bearing member configured to bear a toner image;

an intermediate transferring belt having ionic conductivity with an ionic conductive agent;

a contact member that is in contact with an inner peripheral surface of the intermediate transferring belt;

a current supply member that is in contact with an outer peripheral surface of the intermediate transferring belt;

an opposing member that opposes the current supply member through the intermediate transferring belt, wherein the opposing member is in contact with the inner peripheral surface of the intermediate transferring belt, and the opposing member is electrically connected to the contact member;

an environment detection device that detects an environment; and a control unit configured to execute a recovery operation in which in a state where a primary transfer in which a toner image is primarily transferred to the intermediate transferring belt from the image bearing member is not performed, a current is supplied to flow in a flow direction opposite to a flow direction of a current in the primary transfer through the opposing member from the current supply member to move the ionic conductive agent in the intermediate transferring belt, wherein the control unit performs a change of the current supplied to the contact member in the recovery operation based on a detection result of the environment detection device, and the change includes at least one of settings (i) to set an absolute value of the current supplied to the contact member in the recovery operation when an environment temperature indicated in the detection result is a first temperature to be less than an absolute value of the current supplied to the contact member in the recovery operation when the temperature is a second temperature lower than the first temperature, and (ii) to set an absolute value of the current supplied to the contact member in the recovery operation when a humidity of the environment indicated in the detection result is a first humidity to be less than an absolute value of the current supplied to the contact member in the recovery operation when the humidity is a second humidity lower than the first humidity.

2. An image forming apparatus according to claim 1, wherein the contact member performs the primary transfer based on a current supplied from the current supply member to the contact member through the opposing member.

3. An image forming apparatus according to claim 1, wherein an absolute value of the current supplied to the contact member in the recovery operation is equal to or higher than 10% and equal to or lower than 60% of an absolute value of the current supplied to the contact member in the primary transfer.

4. An image forming apparatus according to claim 1, wherein an absolute value of the current flowing through the current supply member in the recovery operation is equal to or higher than 10% and equal to or lower than 60% of an absolute value of the current flowing through the current supply member in the primary transfer.

5. An image forming apparatus according to claim 1, wherein the current supply member is a secondary transfer member configured to secondarily transfer the toner image from the intermediate transferring belt to a recording material.

6. An image forming apparatus according to claim 1, wherein the current supply member is a charge member configured to charge toner remaining on the intermediate transferring belt after the secondary transfer of the toner image from the intermediate transferring belt to a recording material.

7. An image forming apparatus according to claim 1, wherein the current supply member includes a secondary transfer member for the secondary transfer of the toner image from the intermediate transferring belt to a recording material, and a charge member that charges the toner remaining on the intermediate transferring belt after the secondary transfer of the toner image from the intermediate transferring belt to the recording material, and polarities of voltages applied to the secondary transfer member and the charge member in the recovery operation are the same.

8. An image forming apparatus according to claim 7, wherein the opposing member is one member facing both the secondary transfer member and the charge member through the intermediate transferring belt or separate members respectively facing the secondary transfer member and the charge member through the intermediate transferring belt.

9. An image forming apparatus according to claim 1, wherein the intermediate transferring belt includes a base layer having an ionic conductivity by containing the ionic conductive agent, and a surface layer provided on the outer peripheral surface of the base layer of the intermediate transferring belt, the surface layer not having an ionic conductivity.

10. An image forming apparatus according to claim 1, wherein the intermediate transferring belt includes a base layer having an ionic conductivity by containing the ionic conductive agent, and a backside surface layer provided on the inner peripheral surface of the base layer of the intermediate transferring belt, the backside surface layer not having an ionic conductivity.

11. An image forming apparatus according to claim 1, further comprising a voltage maintaining element electrically connected to the contact member and the opposing member, wherein the voltage maintaining element maintains a potential of the contact member at a level equal to a predetermined potential or more when the current is supplied from the current supply member to the contact member through the opposing member in the primary transfer.

12. An image forming apparatus according to claim 11, further comprising a rectification element electrically connected between the voltage maintaining element and a ground, wherein the rectification elements flows a current between the voltage maintaining element and the ground in the primary transfer, and cuts off the current between the voltage maintaining element and the ground in the recovery operation.

* * * * *